United States Patent [19]

Walkington

[11] 4,040,617

[45] Aug. 9, 1977

[54] SHEET FEEDING APPARATUS

[75] Inventor: Colin Walkington, Bristol, England

[73] Assignee: Masson Scott Thrissell Engineering Limited, Bristol, England

[21] Appl. No.: 695,565

[22] Filed: June 14, 1976

[30] Foreign Application Priority Data

June 17, 1975 United Kingdom ..... 25765/75

[51] Int. Cl.[2] ..... B65H 29/38; B65H 29/66

[52] U.S. Cl. ..... 271/177; 83/88; 271/202

[58] Field of Search ..... 83/88; 271/69, 202, 271/177, 178; 198/102

[56] References Cited

U.S. PATENT DOCUMENTS

| | | | |
|---|---|---|---|
| 2,823,033 | 2/1958 | Stromberg | 271/202 |
| 3,336,028 | 8/1967 | Schonmeier | 83/88 X |
| 3,595,564 | 7/1971 | De Young | 83/88 X |
| 3,942,786 | 3/1976 | Lauren | 271/77 |

*Primary Examiner*—Frank T. Yost
*Attorney, Agent, or Firm*—Young & Thompson

[57] ABSTRACT

A sheet overlapping device positioned between fast and slow conveyors checks the fast moving sheets by engaging their trailing ends as they transfer to the slow conveyor. A dabber roller with a spring mounting on a rotary shaft is timed to nip each trailing sheet portion against the upstream end of the slow conveyor and travel with it over a short arc up to the top of the conveyor.

9 Claims, 3 Drawing Figures

SHEET FEEDING APPARATUS

Figure 1:
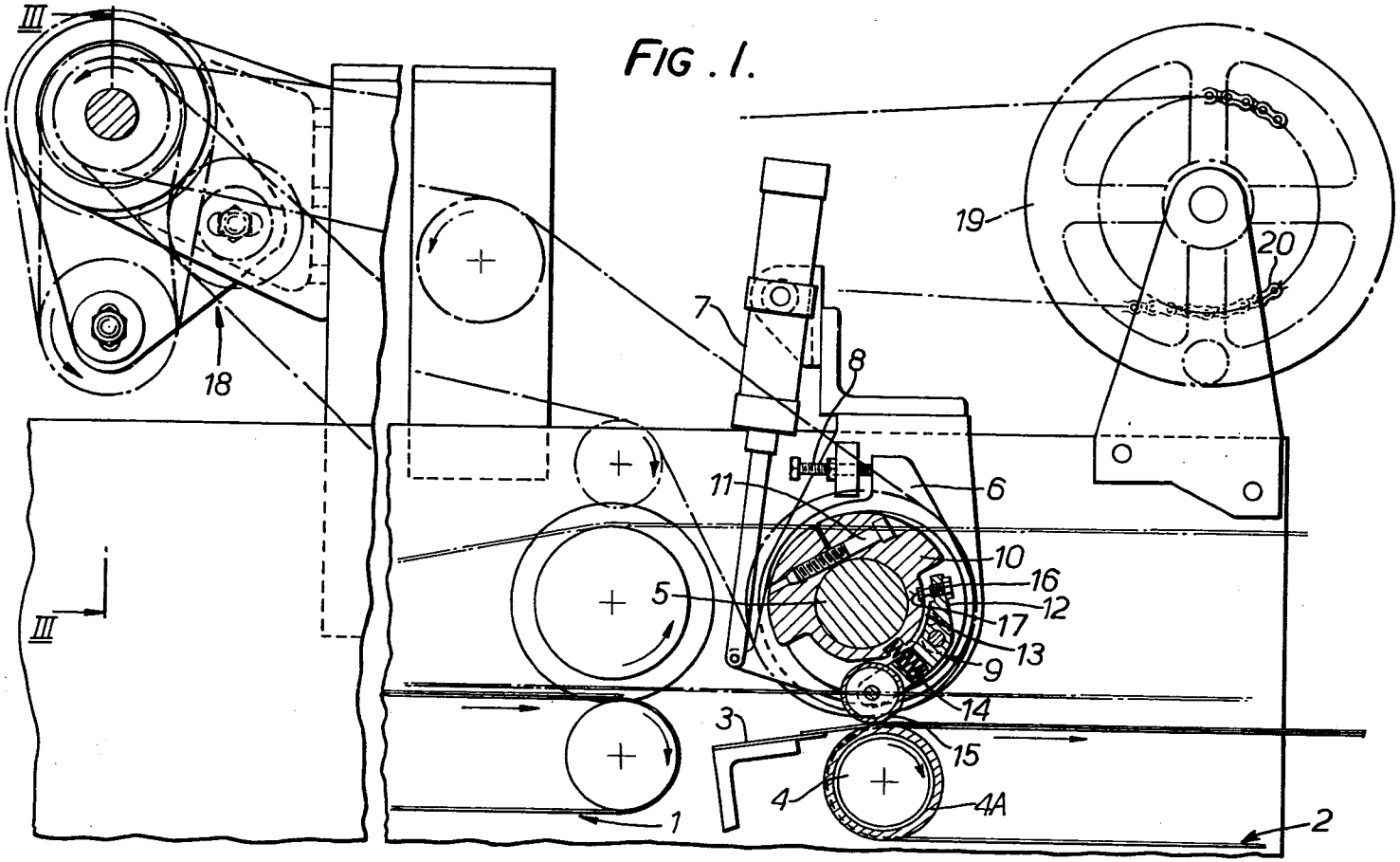

This invention relates to sheet feeding apparatus. It is concerned with slowing down and overlapping sheets as they are delivered from a conveyor, for example the high speed primary conveyor of a paper cutter. This is necessary in order that the paper sheets should be stacked in a controlled and orderly manner on a layboy, to which they are delivered by a low-speed secondary conveyor.

Each sheet requires to be individually handled, which means accurate and high speed operation in order not to interfere with the preceding and following sheets. Braking by obstructing the leading edge of the sheet is unsatisfactory as there is a tendency for the sheet to bend or crumple, and so it is recognised that, if possible, the impedance to the sheet should be applied at or near the trailing edge. At the same time, that trailing edge should be defected so that the leading end of the following sheet will more certainly overlap and not hit edge-to-edge. However the means which act on the trailing edge must be removed almost instantaneously in order not to interfere with the following sheet.

It is an object of this invention to provide a sheet braking and deflecting device that meets this requirement.

According to the present invention there is provided a sheet overlapping device for positioning between a fast upstream conveyor and a slow downstream conveyor, the latter having a roll at its upstream end around which a conveyor element is traversed, comprising a rotary shaft carrying a resiliently mounted rolling element and means for synchronising the rotation of the shaft with the sheet delivery on the fast conveyor, whereby the rolling element will nip the trailing portion of each sheet to the upstream roll of the slow conveyor at a point lower than and upstream of the top run of that conveyor and will travel with that sheet, maintaining the nip, over an arc of rotation of the said roll. elements mounted along the shaft, and they may be adjustable both axially and circumferentially. The rolling elements are preferably carried on collars that can be clamped around the shaft, enabling these adjustments readily to be made. The resilient mounting conveniently consists of a rocker arm with a spring urging the end carrying the rolling element outwardly from the collar, the outward movement being limited by an adjustable stop at the other end of the rocker arm co-operating with the collar.

The shaft is preferably carried by movable bearings so that it can be raised up to a sufficient degree to allow a clear passage for the web material, for the conveyors may occasionally be required to run without use of this device. This movability of the shaft and the adjustability of the rocker arms by its stop can be used to govern the extent of the arc of engagement of the rolling elements with the sheets.

In order that the device need not be stopped in operation to adjust the relationship of the rolling elements to the trailing portions of the sheets, the synchronising means may include a differential in the drive to the shaft which can be manually controlled by an operator to change the phase relationship of the shaft to the cutter drum.

Figure 2:
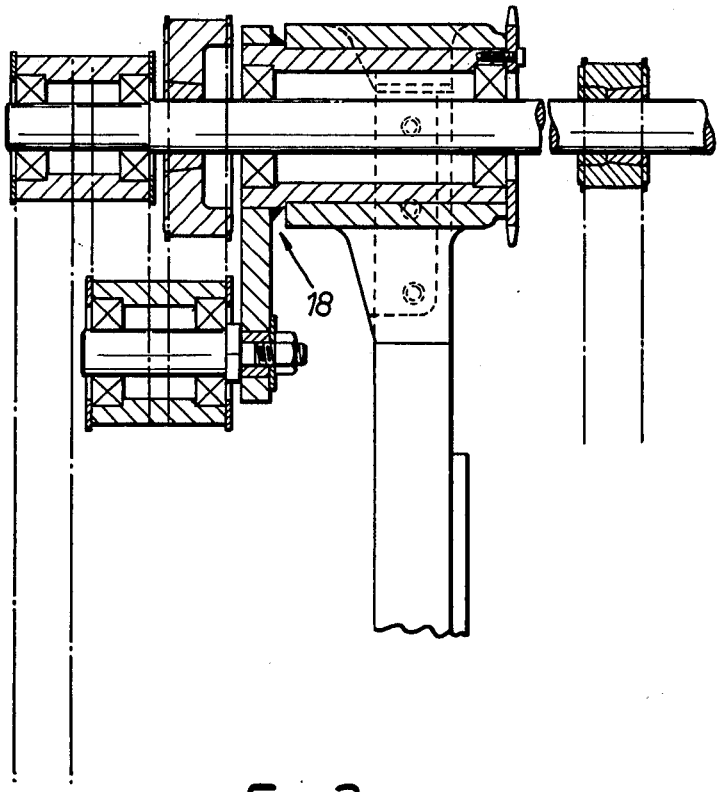
Figure 3:
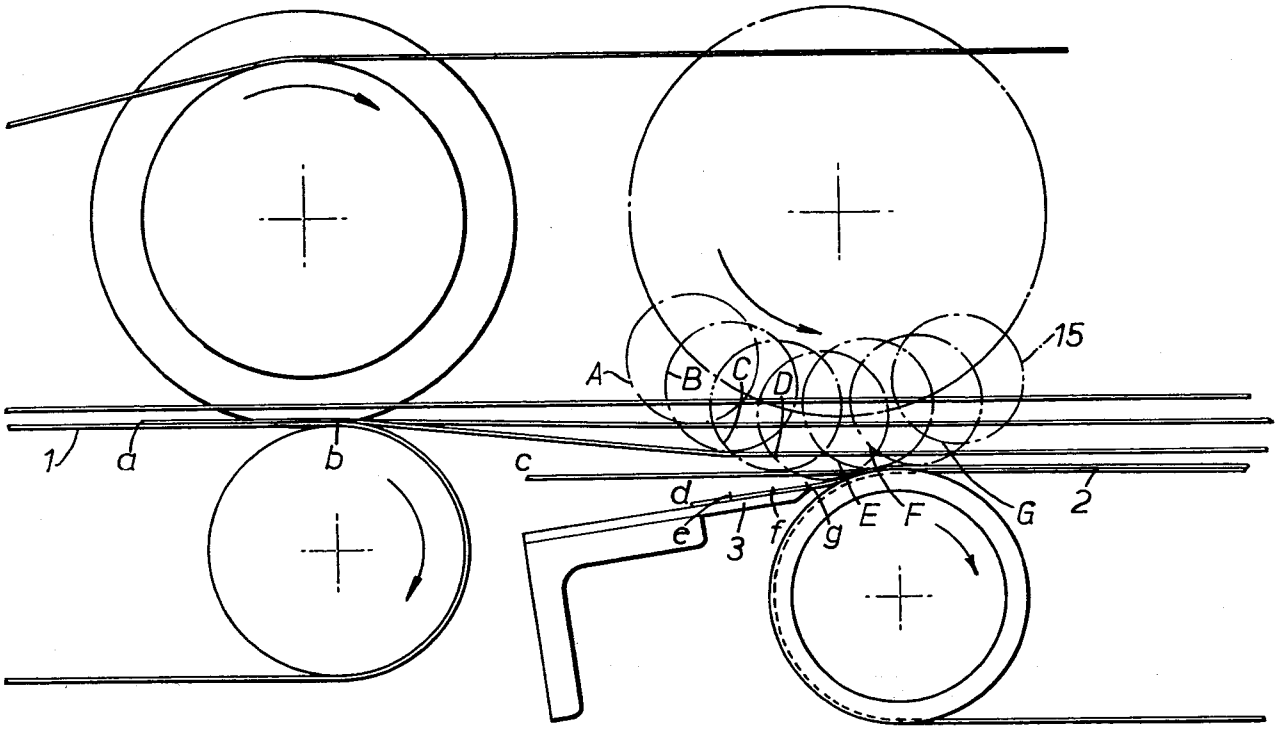

For a better understanding of the invention, one constructional form will now be described, by way of example, with reference to the accompanying drawings, in which:

FIG. 1 is a side elevation, partly in section, of a sheet overlapping device, FIG. 2 is a section on the line 2—2 of FIG. 1, and FIG. 3 is a diagram showing the operation of the overlapping device.

The device is interposed between a primary conveyor 1 on which slightly separated sheets from a cutter (not shown) are delivered at high speed to a secondary conveyor 2, which carries the overlapping sheets at a slower speed to a layboy (also not shown). Within the gap between conveyors there is an overlap plate 3 inclining slightly upwardly to terminate at about the eleven o'clock position in relation to the first roll 4 of the secondary conveyor, which is sheathed with a polyurethane sleeve 4A.

Above and very slightly upstream of the roll 4 a parallel shaft 5 extends across the machine, being mounted in pivoted bearings 6 eccentric to the shaft axis. Thus when an air cylinder 7 coupled to the bearings is actuated the shaft will move towards and away from the roll 4. An adjustable stop 8 limits the downward movement of the shaft. The shaft is rotated in synchronism with the mean cutter knife drum speed so that it performs one revolution for each sheet passing between the conveyors.

The shaft 5 is fitted at adjustable intervals along its length with dabber roller assemblies 9, a dabber roller being a small roller intended to dab down onto a passing sheet to brake and deflect it, as described below. Each assembly 9 comprises a split collar 10 with a clamping screw 11 to hold it in the desired position on the shaft. The screw is engaged in thickened collar portions diametrically opposite and mechanically balancing a rocker arm 12 mounted by a knuckle 13 and urged in an anti-clockwise direction, as seen in FIG. 1, by a spring 14. The shaft 5 rotates in the anti-clockwise direction and at its trailing end the rocker arm carries a freely rotatable dabber roller 15, also polyurethane coated like the roll 4. The pivot axis of the rocker 12 and the axis of the dabber roller are parallel to the axis of shaft 5 and roll 4. The leading end of the rocker arm has a set screw 16 that co-operates with a wear pad 17 set into the collar 10 to govern the limit of radial excursion of the dabber roller 15 from the axis of the shaft 5. This is such that the roller 15 will engage the roll 4 about 25° before the 12 o'clock position and leave it at about the 12 o'clock position. The rocker arm pivots slightly during this period and then reverts to the position where the screw 16 engages the pad 17.

The dabber roller assemblies are individually adjustable both longitudinally of and angularly about the shaft 5. The longitudinal adjustment is made according to the web width and quality before the machine is run, and all the dabber rollers are co-axially aligned. However, their engagement period with the roll 4 may not initially be perfectly synchronised with the cutter delivery, or the synchronism may drift during later operation. Rather than stop the machine to re-adjust the dabber roller assemblies, it is preferred to provide means for adjusting the phase or relative angular position of the shaft 5 with respect to the cutter while both are in motion. A differential drive unit 18 is therefore interposed between the cutter and the shaft 5, and this is controlled by a handwheel 19 adjacent the overlapping device, where the effect of phase adjustment can best be seen. The handwheel rotates the differential drive unit by means of a chain 20. The unit is belt driven and its construction and operation will be best apparent from FIG. 2. In this example, the unit 18 is shown offset some way from the overlapping device for it can be arranged also to control a duplicate device (not shown) below the one illustrated.

The operation of the dabber rollers is illustrated in FIG. 3, where successive roller positions over the crucial arc of sheet engagement are lettered A to G and corresponding sheet trailing edge positions are equivalently lettered *a* to *g*. It will be seen that a sheet is engaged some distance before its trailing edge and deflected downwards (roller positions A, B & C). The dabber rollers then nip the sheet against the relatively slow moving roll 4 before the latter's uppermost point and maintain this nip over the arc corresponding to roller positions D, E and F. The trailing edge portion is bent downwardly to lie on the overlap plate 3, ensuring that the next sheet (not shown) will overlap. Finally, the dabber rollers release the decelerated sheet and swing clear (roller position G) just before the leading edge of the next following sheet arrives at high speed, travelling through the now clear gap above the roll 4.

Throughout this sequence, the dabber rollers are travelling with the sheet, almost parallel to it, and with the resilience afforded by the spring 14, the effect of the nip engagement is comparatively gentle and unlikely to be damaging to the paper or other sheet material.

It will be understood that instead of dealing with single sheets, the overlapping device described could handle spurs, that is multiple sheets, of up to four ply.

I claim:

1. A sheet overlapping device comprising a fast upstream conveyor, a slow downstream conveyor arranged to receive sheets delivered in succession from the fast conveyor, the slow conveyor having a roll at its upstream end around which a conveyor element is traversed, a rotary shaft, a rolling element resiliently mounted on the shaft, and means for synchronising the rotation of the shaft with the sheet delivery on the fast conveyor, the shaft being arranged so that the rolling element will nip the trailing portion of each sheet to the upstream roll of the slow conveyor at a point lower than and upstream of the top run of that conveyor and will travel with that sheet, maintaining the nip, over an arc of rotation of the said roll.

2. A device as claimed in claim 1, wherein there is a plurality of rolling elements mounted along the shaft.

3. A device as claimed in claim 1, wherein the rolling element is adjustable axially of the shaft.

4. A device as claimed in claim 1, wherein the rolling element is adjustable circumferentially of the shaft.

5. A device as claimed in claim 1, wherein the rolling element is carried on a collar clamped to the shaft.

6. A device as claimed in claim 1, wherein the resilient mounting includes a rocker arm and a spring urging the end of the said arm carrying the rolling element outwardly from the shaft.

7. A device as claimed in claim 6, wherein an adjustable stop is provided to limit the outward movement of the rolling element.

8. A device as claimed in claim 1, wherein the shaft is mounted on movable bearings.

9. A device as claimed in claim 1, and further comprising a support for sheet trailing portions deflected by the rolling element immediately upstream of the slow conveyor.

* * * * *